US006059153A

United States Patent [19]

Olson et al.

[11] Patent Number: 6,059,153

[45] Date of Patent: May 9, 2000

[54] CONTAINER FOR POURABLE FOOD PRODUCTS

[75] Inventors: Ronald James Olson, Gurnee; John Robert Tulloch, Chicago; Rebecca Kristine Soper, Des Plaines; Jay Anthony Edwards, Evanston, all of Ill.; Kadir Karul, Racine, Wis.

[73] Assignee: Kraft Foods, Inc., Northfield, Ill.

[21] Appl. No.: 09/169,576

[22] Filed: Oct. 9, 1998

[51] Int. Cl.[7] ..... A47G 19/14

[52] U.S. Cl. ..... 222/465.1; 222/566; 222/572; 222/575

[58] Field of Search ..... 222/465.1, 566, 222/572, 575, 109

[56] References Cited

U.S. PATENT DOCUMENTS

| | | | |
|---|---|---|---|
| D. 93,526 | 6/1934 | Smith . | |
| D. 129,158 | 8/1941 | Dexter . | |
| D. 160,516 | 10/1950 | Marsh | 222/465.1 X |
| D. 205,967 | 10/1966 | Platte . | |
| D. 236,688 | 9/1975 | McCaleb . | |
| D. 244,579 | 6/1977 | Dinand . | |
| D. 244,912 | 7/1977 | Conesa . | |
| D. 285,538 | 9/1986 | Trumstedt . | |
| D. 288,294 | 2/1987 | Taylor et al. . | |
| 684,069 | 10/1901 | Knorr | 222/109 |
| 2,428,588 | 10/1947 | Schroeder et al. | 222/465.1 X |
| 3,536,223 | 10/1970 | Muhlhoff et al. | 215/1 |
| 3,537,498 | 11/1970 | St. Amand | 150/0.5 |
| 3,700,146 | 10/1972 | Cousins et al. | 222/465.1 |
| 3,923,178 | 12/1975 | Welker, III | 215/1 |
| 4,116,350 | 9/1978 | Allasia | 215/31 |
| 4,117,946 | 10/1978 | Kessler | 215/321 |
| 4,387,816 | 6/1983 | Weckman | 215/1 |
| 4,493,427 | 1/1985 | Wolkonsky | 215/230 |
| 4,703,871 | 11/1987 | Broker | 222/465.1 X |
| 4,724,855 | 2/1988 | Jackson et al. | 134/93 |
| 4,749,092 | 6/1988 | Sugiura et al. | 215/1 |
| 4,804,097 | 2/1989 | Alberghini et al. | 215/100 |
| 4,805,788 | 2/1989 | Akiho | 215/1 |
| 4,863,046 | 9/1989 | Collette et al. | 215/1 |
| 4,877,141 | 10/1989 | Hayashi et al. | 215/1 |
| 4,890,752 | 1/1990 | Ota et al. | 215/1 |
| 4,946,053 | 8/1990 | Conrad | 215/1 |
| 4,993,565 | 2/1991 | Ota et al. | 215/1 |
| 5,092,474 | 3/1992 | Leigner | 215/1 |
| 5,123,554 | 6/1992 | Arvidson et al. | 215/12.2 |
| 5,141,120 | 8/1992 | Brown, et al. | 215/1 |
| 5,148,930 | 9/1992 | Ota et al. | 215/1 |
| 5,261,544 | 11/1993 | Weaver, Jr. | 215/1 |

FOREIGN PATENT DOCUMENTS 2218395 11/1989 United Kingdom .

OTHER PUBLICATIONS

U.S. Design Application No. 29/094,811, Olson et al., Container, Filed Oct. 9, 1998.

*Primary Examiner*—Joseph A. Kaufman
*Assistant Examiner*—Thach Bui
*Attorney, Agent, or Firm*—Fitch, Even, Tabin & Flannery

[57] ABSTRACT

A blow-molded polymeric container having an enlarged annular neck and a spout integrally molded on at least one side wall beneath the neck. The neck defines a mouth opening which is offset from a vertical axis in the direction of the spout.

20 Claims, 4 Drawing Sheets

CONTAINER FOR POURABLE FOOD PRODUCTS

FIELD OF THE INVENTION

The present invention relates generally to containers and more particularly to a container for pourable food products.

BACKGROUND OF THE INVENTION

In providing a container for commercial packaging of food products, among the considerations that must be addressed are the ability of the container to receive food product in filling operations, the degree of difficulty that will be encountered by the consumer in dispensing food product from the container, the ability of the container to withstand various loads, such as stacking loads during filling, sealing, shipping, display and consumer use, and the ability of the container to be packed efficiently among like containers. Also, it is desirable that a container have ample label display area and an aesthetically pleasing appearance. In addition, the container must be capable of inexpensive manufacture.

A disadvantage with some larger containers is their inability to be easily handled and controlled. This disadvantage may be accentuated in dispensing the food product when it may be desirable to hold the container in an inclined position and with one hand. Large containers may be particularly unwieldy, making it difficult to hold the container steady and to direct the flow of food product.

Additionally, it may be desirable to have the ability to either pour the food product from the container or to spoon, or otherwise manually remove, the food product from the container. An enlarged annular neck defining an opening, which allows such access for a large spoon, on a larger container, however, may present additional difficulties when pouring the food product contained therein into smaller containers or directly onto other food products. For example, it may be particularly difficult to control the flow rate of food product exiting the container in order to limit the amount dispensed or to control the accuracy with which the food product being dispensed is directed into smaller sized containers.

A general object of the present invention is to provide a relatively large container suitable for commercial packaging of food product which has an enlarged annular opening to allow food product to be dispensed from the container by pouring into smaller containers or directly onto food products or to be manually removed using a spoon or other utensil.

SUMMARY OF THE INVENTION

In accordance with the invention, there is provided a container for pourable food products which provides improved flow control during pouring while also permitting a large spoon or other utensil to be employed for dispensing food products. The container comprises a generally horizontal bottom wall, at least one upstanding side wall extending up from the bottom wall, and an annular neck defining an opening and comprising means for cooperating with a closure to seal the container. At least one side wall slopes at a first angle to intersect the annular neck. A portion of the side wall extends up to the neck at a second angle different from the first angle to form a spout to facilitate pouring of pourable food products from the container at the location of the spout. The annular neck is offset in the direction of the spout from a vertical axis through the container to facilitate pouring of pourable food products from the spout.

The spout preferably comprises two spout walls which form essentially a V-shaped spout that extends up to the neck. Preferably, the spout extends beneath the neck and into the interior of the opening, partially undercutting the spout. A shelf spans between the top edge of each of the spout walls and the neck. The combination of the offset neck and the spout contribute to easier, more accurate pouring from the container, because the opening can be brought close to the second container or food product and the spout helps to control flow.

A handle is diametrically opposed from the spout to facilitate handling of the container when pouring. The handle is positioned in a recessed section at the back of the container and includes a hand grip and gripping surface to improve gripping.

DETAILED DESCRIPTION OF THE PREFERRED EMBODIMENT

Figure 2:
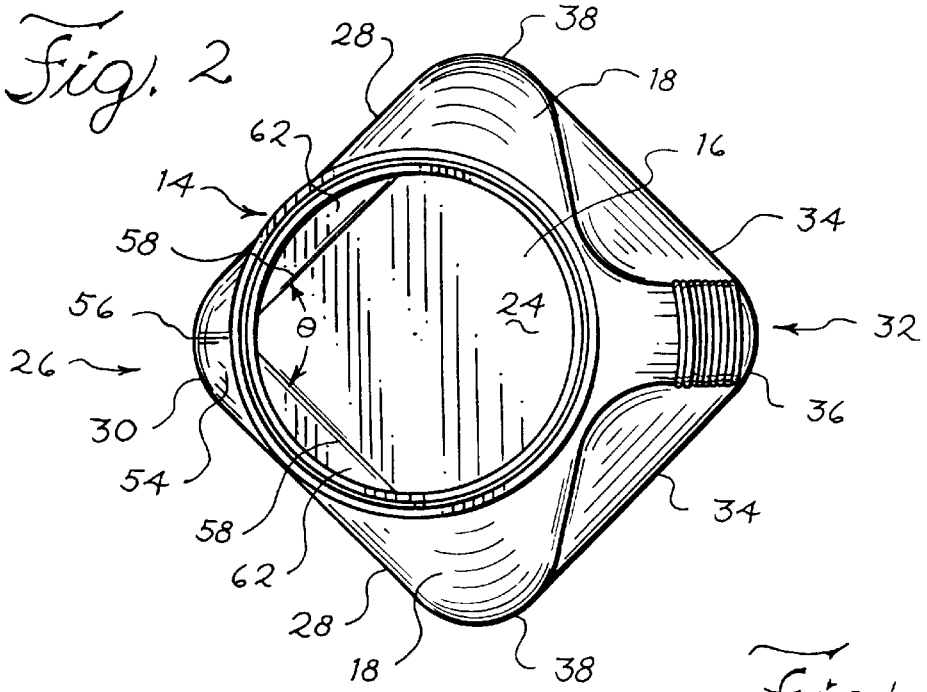
FIG. 2 is a top plan view of the container of FIG. 1.
Figure 1:
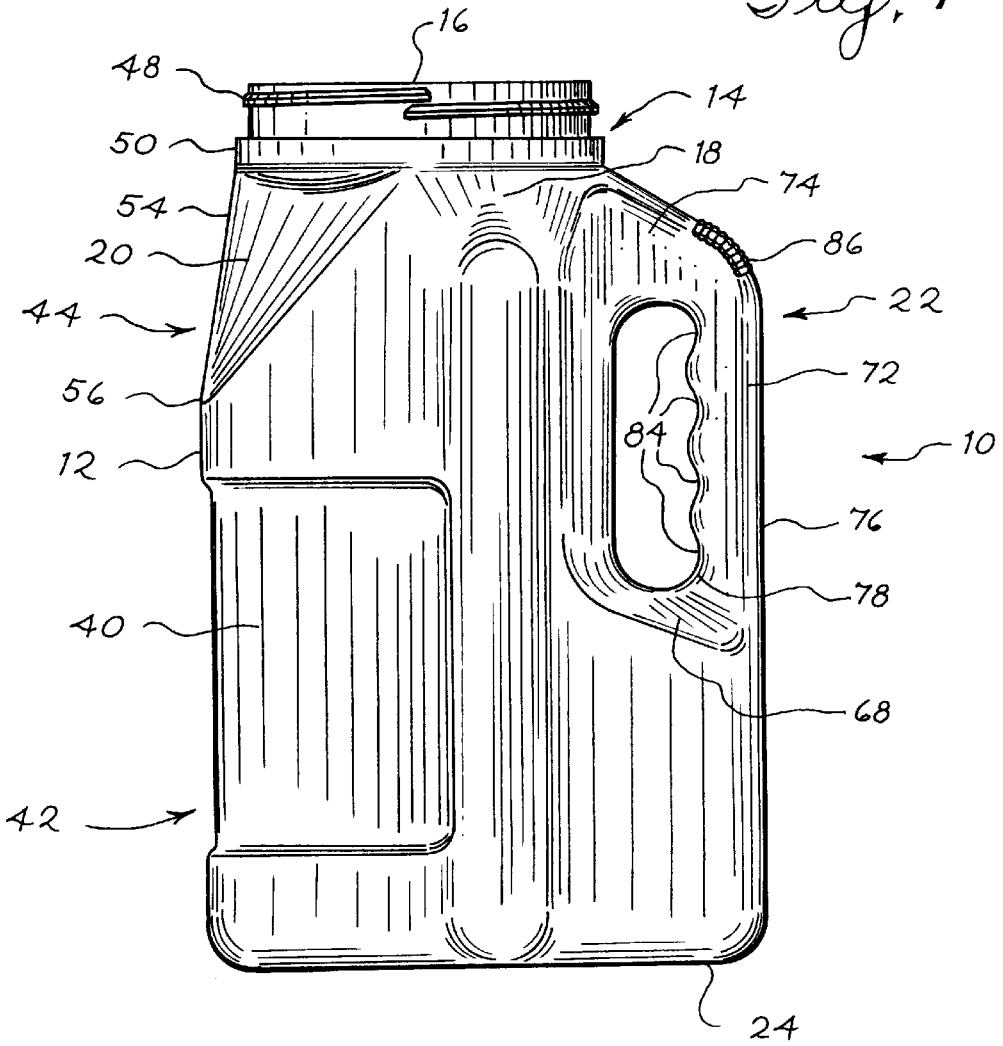
FIG. 1 is a side elevational view of a container embodying the invention.

The present invention generally is embodied in a container 10 for pourable food products, such as dressings and sauces. In the illustrated embodiment, as shown in FIG. 1, the container 10 generally comprises a body 12, an enlarged annular neck 14 defining an opening 16, two side shoulders 18, a handle 22 and a bottom wall 24. As also shown in FIG. 2, the container 10 has a front side 26, comprising two side walls 28 and a front corner 30, a back side 32, comprising two side walls 34 and a back corner 36, as well as two side corners 38. The container 10 also has a recessed panel 40 on at least one side wall 28 for displaying labels or for other use.

The body 12 has a lower portion 42 having a generally square configuration with four upstanding side walls 28 and 34 of essentially equal width and an upper portion 44 in which a section of the body 12 is recessed to accommodate the handle 22. The cross-section of the body 12 at the upper portion 44 is reduced relative to that of the lower portion 42 to enable the handle 22 to fit within the area defined by the perimeter of the bottom wall 24. The side walls 34 of the back side 32 do not extend vertically along the entire height of the container 10 but terminate at the base of a recessed section 46 within which the handle 22 is located. Each of the side walls 28 and 34 intersects adjacent side walls along rounded vertical corners 30, 36 and 38.

The annular neck 14 defines a mouth opening 16 preferably having an inner diameter of at least about 3.5 inches and, more preferably, at least about 4.0 inches, to allow a large spoon or other utensil or possibly a person's hand holding a utensil to pass into the interior of the container 10 to manually remove food product through the opening 16 without pouring. The neck 14 includes an exterior thread 48 for engagement with a corresponding interior thread on a cooperating lid (not shown) and a projecting ring 50 therebelow. The axis of the neck 14 is offset from a vertical axis through the center of the container 10. Preferably, the neck 14 is offset as far to the front corner 30 of the container 10 as possible, consistent with the limitations of commercial blow molding processes, to allow the neck 14 to be brought up close to a second, different container into which food product is poured. Preferably, the neck 14 does not protrude beyond the side walls 28 and 34, so as to improve packaging arrangements and maximize the number of containers packed in a particular carton for shipping and storage.

To facilitate dispensing of product and improve control over product flow during pouring, a spout 20 is integrally molded on the front side walls 28 between the two side shoulders 18 at the upper portion 44 of the container 10. Preferably, the spout 20 is disposed at the front corner 30 beneath the neck 14 to maximize the funneling effect of the front corner 30 when pouring the food product. The spout 20 slopes upward from the front corner 30 to the neck 14 at an angle different from either the side walls 28 and 34 or the shoulders 18. Preferably, the spout 20 extends up beneath the neck 14 and into the interior of the opening 16, partially undercutting the neck 14, to facilitate funneling of the food product through the opening 16 as the food product is poured from the container 10.

As a result of this funneling effect, the food product generally will be dispensed through a smaller arc of the circumference of the opening 16 as compared to pouring from a container not having the spout. Thus, the spout 20 makes it easier to pour the food product accurately and cleanly into smaller containers because the stream of food product dispensed from the container 10 will have a narrower cross-section. Some restraint must still be used, however, when dispensing food product from a container that is more than about ⅔ full, as an undesirably high flow rate will be facilitated by the enlarged opening 16. If the flow rate becomes too high, the benefits of the spout 20 will not be recognized because the food product will overflow from the spout 20 without any funneling effect.

Figure 4:
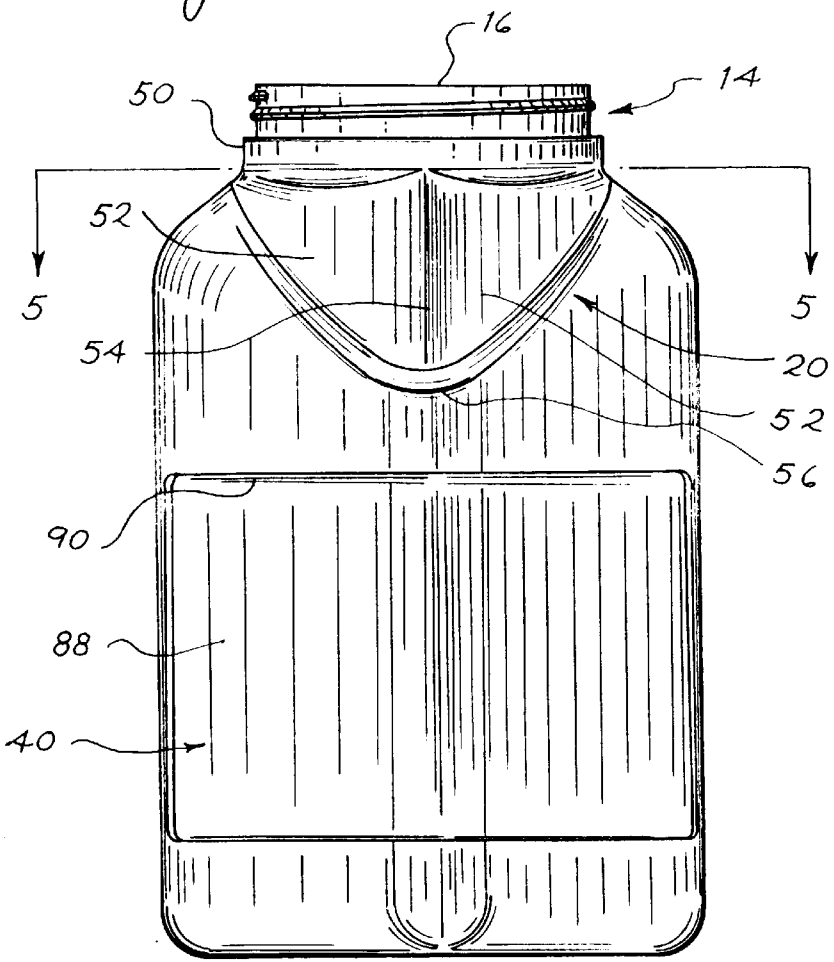
FIG. 4 is a front elevational view of the container of FIG. 1.
Figure 3:
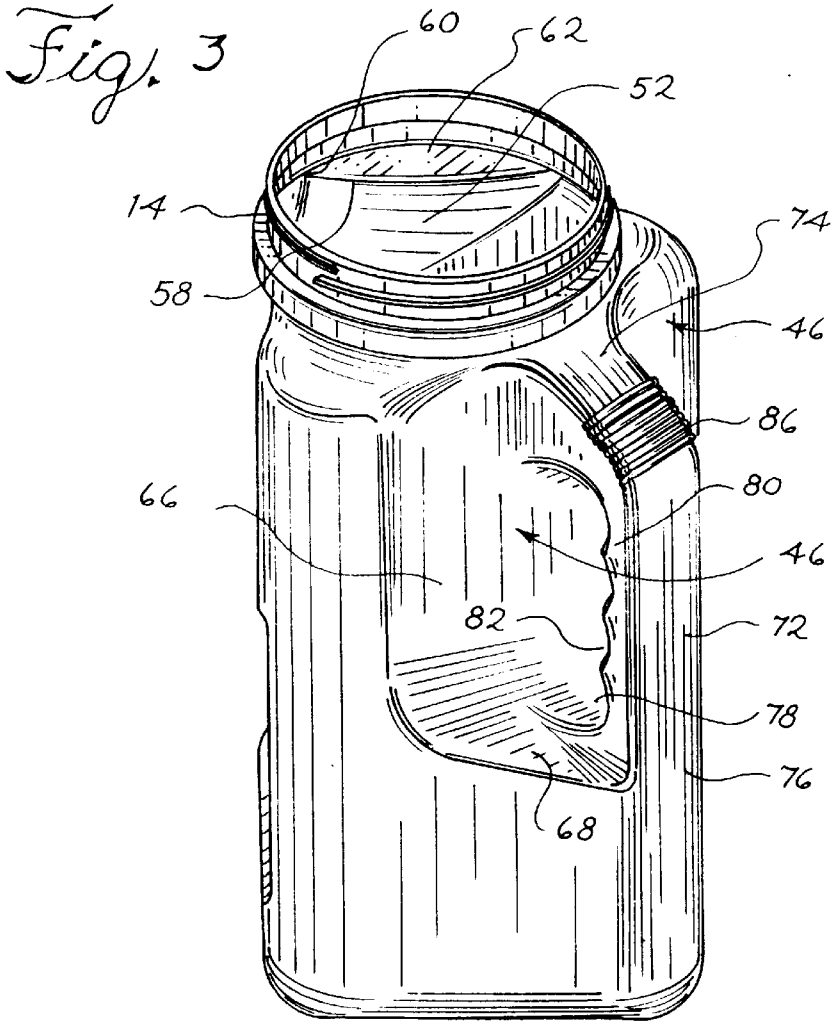
FIG. 3 is a side perspective view of the container of FIG. 1.
Figure 5:
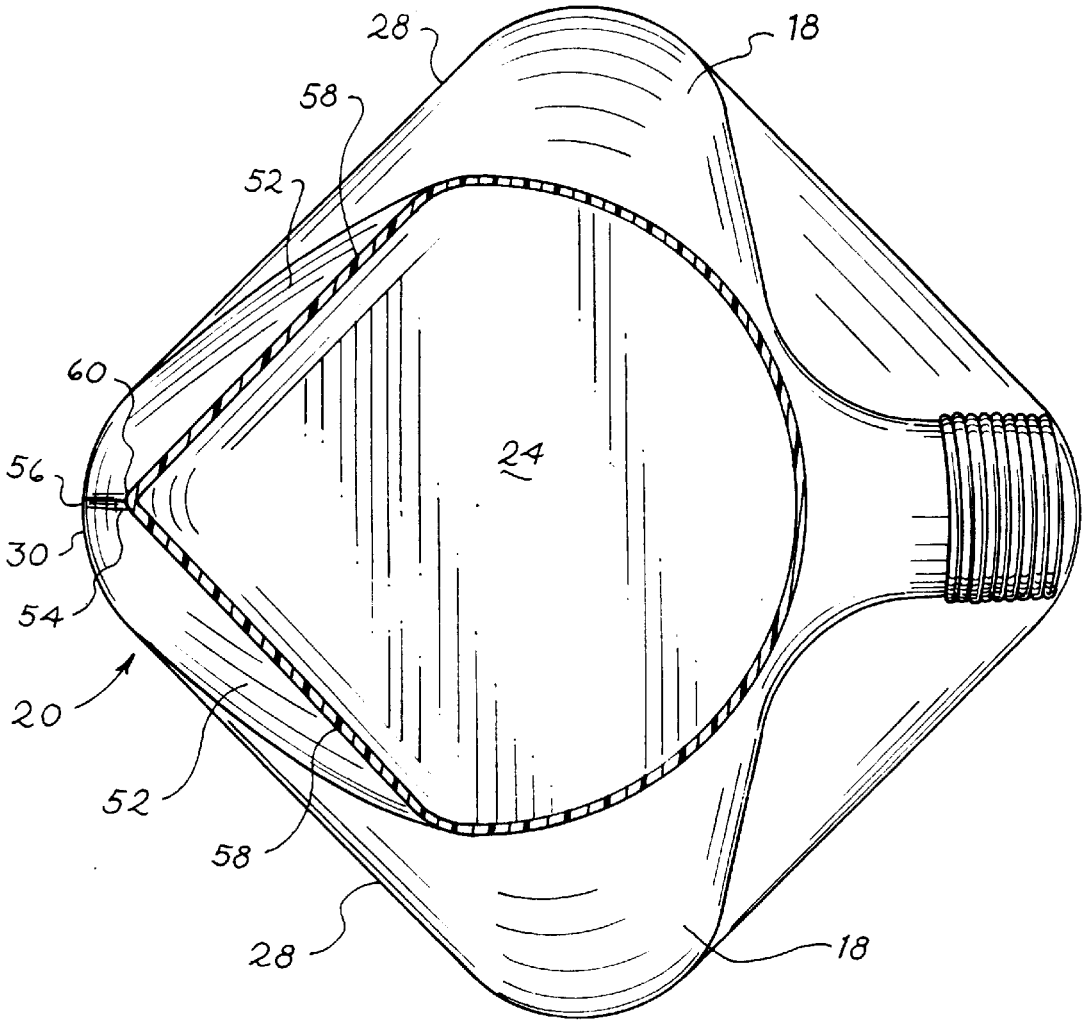
FIG. 5 is a top plan view of the container of FIG. 1 with a sectional view taken along line 5—5 of FIG. 4.

As best seen in FIGS. 4 and 5, the spout 20 preferably has two spout walls 52 which form a V-shaped spout as viewed in plan. The point of the "V" corresponds to the edge 54 of the spout 20 that projects outwardly from the container 10. This edge 54 forms essentially a line that extends between the front corner 30 and the bottom of the neck 14. The base 56 of the spout 20 is curved around the front corner 30. The width of each spout wall 52 increases moving away from the front corner 30 and is widest near the neck 14. Correspondingly, the depth of the spout 20, as viewed in top plan, is greatest at the neck 14. The spout walls 52 preferably are essentially planar or slightly inwardly convex to facilitate funneling of food product along the spout 20.

As best seen in FIG. 2, the spout walls 52 terminate at the neck 14, and the edges 58 of the spout walls 52 form two chords of equal length within the circumference of the neck 14. The angle θ between the edges 58 preferably is between about 90° and 120°. The spout walls 52 may intersect at a point 60 on the circumference or may be slightly spaced apart. The funneling effect of the spout 20 is greater as θ decreases and as the distance between the spout walls 52 near the point decreases.

At the ring 50 of the neck 14, a narrow shelf 62 spans the distance between the base of the ring 50 and each of the spout walls 52, thereby connecting the neck 14 with the spout 20. Preferably, the shelves 62 slope downwardly toward the spout 20 to facilitate flow of food product from the container 10, as well as flow back into the container 10 after dispensing is completed. To this extent, it is desirable to minimize the width of each shelf 62 to minimize impedance by the shelves 62 of flow of food product back into the container 10, while still maintaining the "V" shape of the spout 20 at the interior of the neck 14 for purposes of funneling, as discussed above. Preferably, each shelf 62 intersects the spout wall 52 to define a curved edge 58.

Figure 6:
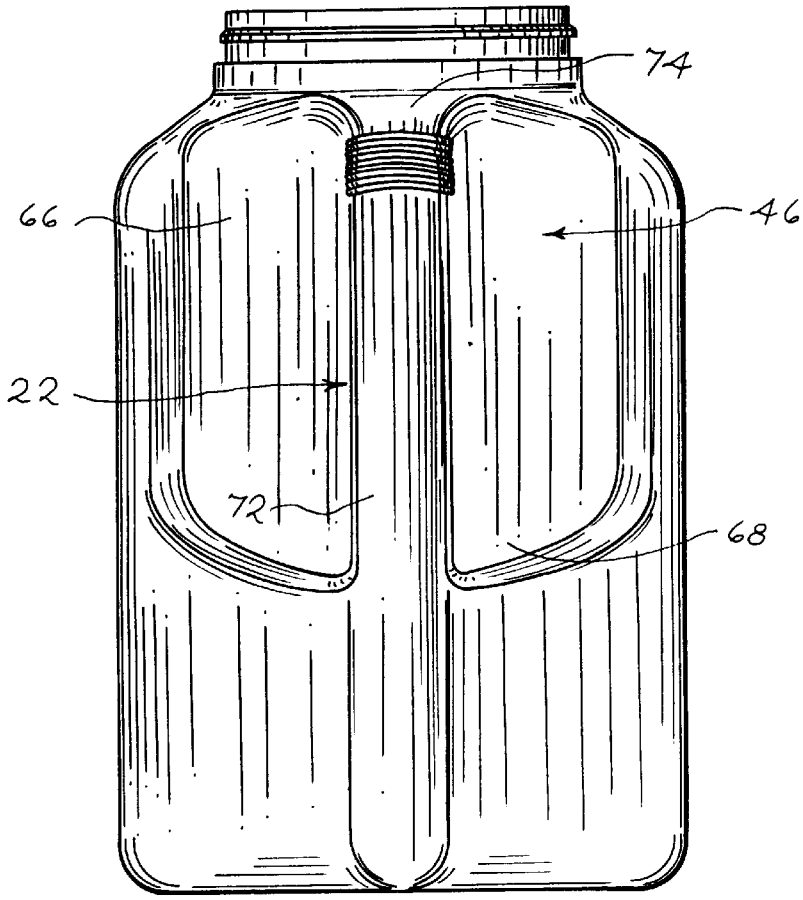
FIG. 6 is a back elevational view of the container of FIG. 1.

Referring now also to FIG. 6, the recessed section 46 at the back 32 of the container 10 is defined by an upstanding back wall 66 and a sloping base wall 68. The back wall 66 generally is parallel to the plane through the two side corners 38 but is set back into the back side 32 of the container 10. The back wall 66 may be substantially planar or outwardly convex as desired to increase the volume of the container 10. The base wall 68, which is generally triangular-shaped, slopes away from the back wall 66 toward the back 32 of the container 10. The slope of the base wall 68 is effective for facilitating flow of food product within the container along the interior surface of the base wall 68 toward the opening 16 when the container is inverted for pouring.

The handle 22 projects from the recessed section 46. The handle 22 comprises a lower part 72, which is substantially vertical and which projects upward from the base wall 68, and an upper part 74, which projects outward from the back wall 66 below the neck 14 and then curves into the lower part 72. Preferably, the handle 22 comprises an outer wall 76, an inner wall 78 and two side walls 80 which define a hollow interior of the handle 22 which is open to the interior of the container 10 at both ends of the handle 22 to allow food product to pass through the handle 22 from the interior of the container 10.

A hand grip 82 with finger coves 84 is configured on the inner wall 78 of the lower part 72. The hand grip 82 comprises four arcuate finger coves 84 shaped and spaced to conform to a user's fingers when gripping the handle 22. The uppermost cove 84 is integral with the inner wall 78 of the upper part 74 which then curves into the back wall 66. The radius of curvature increases along the upper part 74 into the back wall 66. The lowermost cove 84 curves into the base wall 68, with a slightly increasing radius of curvature.

The outer wall 76 along the upper part 74 slopes upward toward the neck 14, and the side walls 80 curve gradually into the back wall 66. The combination of the sloping outer wall 76 and curved side 80 and inner 78 walls provides an increased cross-section of the handle 22 in the direction of the back wall 66 to increase the strength and rigidity of the handle 22 and improve the load bearing capacity of the handle 22. Additionally, the slope of the upper part of the outer wall 76 facilitates flow of food product through the interior of the handle 22 when the container 10 is inverted for pouring.

A raised gripping surface 86 is provided on the outer wall 76 along the upper part 74 to at least the top of the lower part 72. The gripping surface 86 comprises at least one raised rib or other shape positioned transversely across the outer wall 76 for engagement with a user's thumb. The gripping surface 86 stabilizes gripping and prevents the thumb from slipping along the outer wall 76 during handling and pouring, especially when an increased volume of food product is contained in the container 10. Preferably, the gripping surface 86 extends transversely across the entire width of the outer wall 76.

The recessed panel 40 preferably wraps around the front corner 30 on the two front side walls 28. The panel 40 comprises a substantially vertical central portion 88 on the two side walls 28 that is slightly recessed from the surface of the side walls 28. The panel 40 extends vertically from about the upper portion 44 down to or near the bottom wall 24 at the lower portion 42 and horizontally from side corner to side corner 38 across the width of the two front side walls 28. The area of the panel 40 may be modified to accommodate various size labels or as otherwise required. The panel 40 is bounded by an integral rim 90 on at least the top and bottom edges of the panel 40. The rim 90 slopes inwardly from the side wall 28 to the recessed surface of the panel 40.

The remaining surfaces of the side walls 28 and 34 may have a textured pattern, engravings, markings or other ornamentations thereon, as desired.

Side shoulders 18 are located above each of the side corners 38. The side shoulders 18 extend downwardly from the neck 14 to the side corners 38. The slope of the side shoulders 18 is effective for preventing hang up of food product within the interior of the shoulders 18 when the container 10 is inverted for pouring. Further, the side shoulders 18 curve gradually into the side walls 28 at the front side 26 but curve more definitely into the back wall 66 of the recessed section 46 and the side corners 38.

Figure 7:
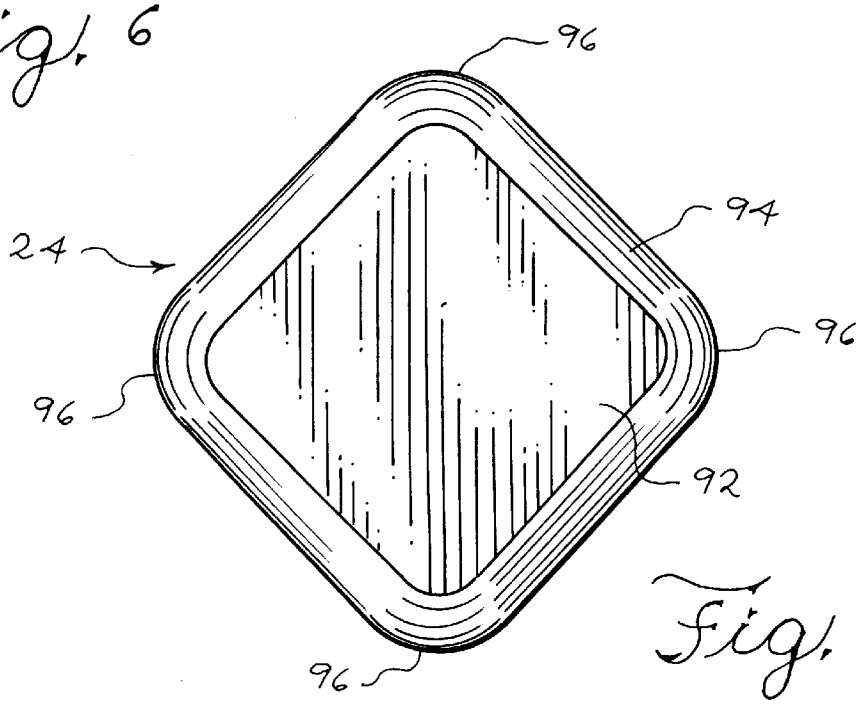
FIG. 7 is a bottom plan view of the container of FIG. 1.

Referring now to FIG. 7, the bottom wall 24 of the container 10 has a generally square configuration, as viewed in bottom plan. A recessed central portion 92 is surrounded by an outwardly convex rim 94. The rim 94 provides stability for the container 10 when supported on a flat, horizontal surface. The side walls 28 and 34 are contiguous with the rim 94 around the perimeter of the bottom wall 24. The side walls 28 and 34 intersect the rim 94 along a rounded edge. The side walls 28 and 34 intersect adjacent side walls 28 and 34 at the bottom wall 24 to form rounded bottom corners 96.

The following describes possible dimensions, for purposes of example only, of a container embodying the features of the present invention. The container preferably is an extrusion blow-molded container of a suitable, food grade polymeric material such as HDPE. The container may have a minimum wall thickness of at least about 12 mils and an empty weight of about 125 to about 135 grams. The container may have a total volume of between about 125 to about 130 ounces, with an overflow capacity of between about 136 to about 140 ounces. In one particular embodiment, the container has a volume of 128 ounces, with an overflow capacity of 138 ounces.

The height of the container may be between about 10 and about 11 inches, including the annular neck. The width of each side wall may be between about 4 and about 5 inches. The length of the spout along the side walls may be between about 2 to about 3 inches, and the maximum width of each spout wall may be between about 2.5 to about 3.5 inches. The maximum width of each shelf may be between about 0.25 and about 0.5 inches.

The diameter of the opening at the neck may be between about 3.5 and about 4.5 inches. The neck may be offset from a vertical axis through the container by between about 0.5 to about 1.0 inches in the direction of the spout.

From the foregoing, it should be appreciated that the invention provides a container for pourable food product having an enlarged, offset neck and a novel spout arrangement. The enlarged neck allows food product to be manually removed from the container without pouring. Although a preferred embodiment has been described above and illustrated in the accompanying drawings, there is no intent to limit the scope of the invention to this or any other particular embodiment. Numerous alternatives, modifications and variations will be apparent to those skilled in the art in view of the foregoing description. For example, rather than having a generally square footprint, the container might have a generally circular footprint, with a generally cylindrical side wall, or might have another shape. Also, various handle configurations other than that shown might be employed. The container may be made in various sizes, and may be made of various food grade plastic materials. The invention is further described and pointed out by the following claims.

What is claimed is:

1. A pourable food product container comprising:

a generally horizontal bottom wall;

an annular neck defining an opening for dispensing of food product and comprising a finish having a threaded outer surface for engagement with a cap; and at least one upstanding side wall extending upward from the bottom wall;

wherein a portion of the at least one side wall defines a spout which facilitates pouring of pourable food products from the container at the spout by guiding flow toward the center of the spout during pouring;

and wherein the annular neck is offset in the direction of the spout from a vertical axis through the container to facilitate pouring of pourable food products through the annular neck at the spout, the spout partially undercutting the annular neck.

2. A container in accordance with claim 1 wherein the spout comprises two spout walls which form essentially a V-shaped spout.

3. A container in accordance with claim 2 wherein the spout walls extend below and inwardly of at least a section of the annular neck, and wherein a shelf spans between the annular neck and each spout wall, each shelf sloping inwardly and having relatively small surface area to facilitate flow of pourable food product back into the container.

4. A container in accordance with claim 3 wherein the opening is large enough to permit access to the container interior by a spoon or other utensil employed for removing the pourable food product from the container without pouring, the opening having an inner diameter of at least about 3.5 inches.

5. A container in accordance with claim 1 further comprising a handle.

6. A container in accordance with claim 5 wherein the handle is diametrically opposed from the spout to facilitate handling of the container when pouring.

7. A container in accordance with claim 2 wherein the width of the container is at least about 4 inches and the axis of the annular neck is offset from the vertical axis of the container by at least about 0.5 inches.

8. A container in accordance with claim 6 wherein the handle comprises a textured surface for improved gripping.

9. A container in accordance with claim 8 further comprising a recess in at least one side wall shaped to accommodate a label and a textured surface on at least a section of at least one side wall.

10. A container in accordance with claim 8 wherein the container has a capacity of at least about 125 fluid ounces.

11. A container in accordance with claim 10 wherein the container is a polymeric blow-molded container.

12. A pourable food product container comprising:

a generally horizontal bottom wall;

an annular neck defining an opening for dispensing of food product and comprising a finish having an outer surface for engagement with a cap; and at least one upstanding side wall extending upward from the bottom wall;

wherein a portion of the at least one side wall defines a spout comprising at least one spout wall, the spout partially undercutting the neck, and wherein the spout facilitates pouring of pourable food products from the container at the spout by guiding flow toward the center of the spout during pouring;

wherein the spout wall extends below and inwardly of at least a section of the annular neck, and wherein a shelf spans between the annular neck and each spout wall, each shelf sloping inwardly and having relatively small surface area to facilitate flow of pourable food product back into the container, and wherein the annular neck is offset in the direction of the spout from a vertical axis through the container to facilitate pouring of pourable food products through the annular neck at the spout.

13. A container in accordance with claim 12 wherein the opening is large enough to permit access to the container interior by a spoon or other utensil employed for removing the pourable food product from the container without pouring, the opening having an inner diameter of at least about 3.5 inches.

14. A container in accordance with claim 13 wherein the spout comprises two spout walls which form essentially a V-shaped spout.

15. A container in accordance with claim 12 wherein the width of the container is at least about 4 inches and the axis of the annular neck is offset from the vertical axis of the container by at least about 0.5 inches.

16. A container in accordance with claim 15 further comprising a handle, wherein the handle is diametrically opposed from the spout to facilitate handling of the container when pouring.

17. A container in accordance with claim 16 wherein the width of each shelf between the neck and the spout wall is between about 0.25 and about 0.5 inch.

18. A container in accordance with claim 17 wherein the container is a polymeric blow-molded container having a capacity of at least about 125 fluid ounces.

19. A pourable food product container comprising:

a generally horizontal bottom wall;

an annular neck defining an opening for dispensing of food product and comprising a finish, wherein the opening is large enough to permit access to the container interior by a spoon or other utensil employed for removing the pourable food product from the container without pouring, the opening having an inner diameter of at least about 3.5 inches;

at least one upstanding side wall extending upward from the bottom wall; and a spout, wherein a portion of the at least one side wall defines the spout and wherein the spout facilitates pouring of pourable food products from the container at the spout by guiding flow toward the center of the spout during pouring;

wherein the spout comprises two spout walls, the spout walls extending below and inwardly of at least a section of the annular neck, the spout partially undercutting the annular neck, and wherein a shelf spans between the annular neck and each spout wall, each shelf sloping inwardly and having relatively small surface area to facilitate flow of pourable food product back into the container, and wherein the annular neck is offset in the direction of the spout from a vertical axis through the container to facilitate pouring of pourable food products from the spout.

20. A container in accordance with claim 19 further comprising a handle, wherein the handle is diametrically opposed from the spout to facilitate handling of the container when pouring.

* * * * *